US005325936A

United States Patent [19]

Baker

[11] Patent Number: 5,325,936

[45] Date of Patent: Jul. 5, 1994

[54] LADDER LEVELER

[76] Inventor: Gerald Baker, 2526 Valley View Dr., Missoula, Mont. 59803

[21] Appl. No.: 90,695

[22] Filed: Jun. 11, 1993

[51] Int. Cl.[5] ..... E06C 7/44

[52] U.S. Cl. ..... 182/204; 182/111

[58] Field of Search ..... 182/200–205, 182/107–111; 248/188.5, 188.8

[56] References Cited

U.S. PATENT DOCUMENTS 2,936,849 5/1960 Larson ..... 182/111 X 4,423,797 1/1984 Batten ..... 182/204

*Primary Examiner*—Alvin C. Chin-Shue

[57] ABSTRACT

A ladder leveler device to level and stabilize a ladder on an uneven surface, comprising a generally rectangular shaped base plate having a plurality of threaded holes located on each wide end, a plurality of hollow jack screws complimentary to and threading through the plurality of threaded holes on each wide end, a plurality of Allen head bolts reposing freely within the hollow jack screws, washers and lock-nuts on the plurality of Allen head bolts, a square tubular guide attaching longitudinally to the center of the rectangular shaped base plate, a square tubular shaft which is slidable within the square tubular guide, a plurality of longitudinally aligned holes in the center of one longitudinal side of the square tubular shaft, a restraint on one end of the square tubular shaft, a longitudinal cut-out in the center of the side of the square tubular shaft opposite the longitudinal side with the plurality of longitudinally aligned holes, a pivoting foot securing to the square tubular shaft by means of a bolt, a plurality of spacers and a locknut, and a spring biased pin means attaching to the center of the square tubular guide having a circular shaft extending through the square tubular guide, the longitudinal cutout, the plurality of longitudinally aligned holes, and a complimentary hole on the square tubular guide opposite where the spring biased pin means is mounted.

8 Claims, 3 Drawing Sheets

LADDER LEVELER

BACKGROUND OF THE INVENTION

1. Field of Invention

This invention relates to a novel device for use with a ladder and more particularly to a new device for leveling and stabilizing a ladder on an uneven surface.

2. Description of Possible Prior Art

Ladders have been used throughout history. Ladders must frequently be used at locations that do not provide a level surface for support of the ladder. What is needed is a ladder leveler means that provides safe, secure operation and yet may be produced at low cost. Ladder leveler means to permit upright positioning of the ladder on uneven support surfaces have been developed. But, none of the prior art ladder levelling means have gained acceptance over the years. Some are difficult to attach securely. Some are difficult to adjust. Some are not rigid enough for safe use. Some are prohibitively expensive. And, some are not adaptable to different ladders. It is apparent that previous methods and devices for levelling ladders have not proved satisfactory for many users. Thus, there is a need for a new ladder levelling device that overcomes the shortcomings of earlier designs. The present invention provides a novel ladder leveler device which not only overcomes the deficiencies of earlier devices but also has features and advantages not found in such devices.

The ladder leveler device of the present invention provides a high degree of safety for the user and can be adjusted easily and quickly to conform with different base surfaces. Each manufacturer of ladders designs ladder legs or rails of different size, shape and configuration. Additionally, different ladders are constructed of different types of materials, i.e., wood, aluminum, fiberglass. The ladder leveler device of the present invention is universally applicable to any design and component ladder. The ladder leveler device of the present invention is simple in design and can be produced relatively inexpensively and yet is durable in construction and has a long useful life. Little, if any, maintenance is required to keep the device in good working condition. The device can be mounted on virtually any ladder siderail easily and quickly without special skills or tools.

Hence, the instant device is new, useful as serving to satisfy a definite need at many worksites and unique insomuch as it is universally applicable and maximizes safety while minimizing the expense of manufacture, maintenance and of the time needed to adjust a ladder leveler securely, to wit, time better spent by a workman actually on the job doing what has been contracted for.

SUMMARY OF THE INVENTION

1. Brief Description of the Invention

The instant invention comprises a device to level and stabilize a ladder on an uneven surface, comprising a generally rectangular shaped base plate having a plurality of threaded holes located on each wide end, a plurality of hollow jack screws which are complimentary to and thread through the plurality of threaded holes on each wide end, a plurality of Allen head bolts which repose freely within the hollow jack screws, washers and lock-nuts on the plurality of Allen head bolts, a square tubular guide which attaches longitudinally to the center of the base plate, a square tubular shaft which is slidable within the square tubular guide, a plurality of longitudinally aligned holes in the center of one longitudinal side of the square tubular shaft, a restraint on one end of the square tubular shaft, a longitudinal cut-out in the center of the longitudinal side of the square tubular shaft opposite the longitudinal side with the plurality of longitudinally aligned holes, a pivoting foot which secures to the square tubular shaft by means of a bolt, a plurality of spacers and a locknut, and a spring biased pin means attached to the center of the square tubular guide having a circular shaft extending through the square tubular guide, the longitudinal cutout, the plurality of longitudinally aligned holes, and a complimentary hole on the square tubular guide opposite the spring biased pin means.

2. The Object of the Invention

A principal object of the present invention is to provide a ladder leveler that will overcome the shortcomings of the prior art devices.

A further object is to provide a ladder leveler for mounting on the lower ends of the siderails of a ladder whereby the ladder may be levelled or made vertical on uneven surfaces.

A further object is to provide a ladder leveler which is universally applicable to any design and component ladder. A further object is to provide a ladder leveler that is simple and easy to use.

A still further object is to provide a ladder leveler that is economical in cost to manufacture.

The device serves to enhance safety in the use of ladders, an unquestionably desirable goal.

The objects of the invention are accomplished by the improved ladder leveler. In short, the present invention is new, useful and unique and is a vast improvement over related devices by virtue of its inherent relative simplicity and concomitant relatively inherent economy of manufacture and maintenance not to mention maximal safety of use.

To the accomplishment of the above and related objects, this invention may be embodied in the arrangement, combination and details of construction illustrated in the accompanying drawings and specification, attention being called to the fact, however, that the drawings are illustrative only, and that changes may be made in the specific construction illustrated and described within the scope of the appended claims.

IN THE DRAWINGS

DESCRIPTION OF THE PREFERRED EMBODIMENT

Figure 1:
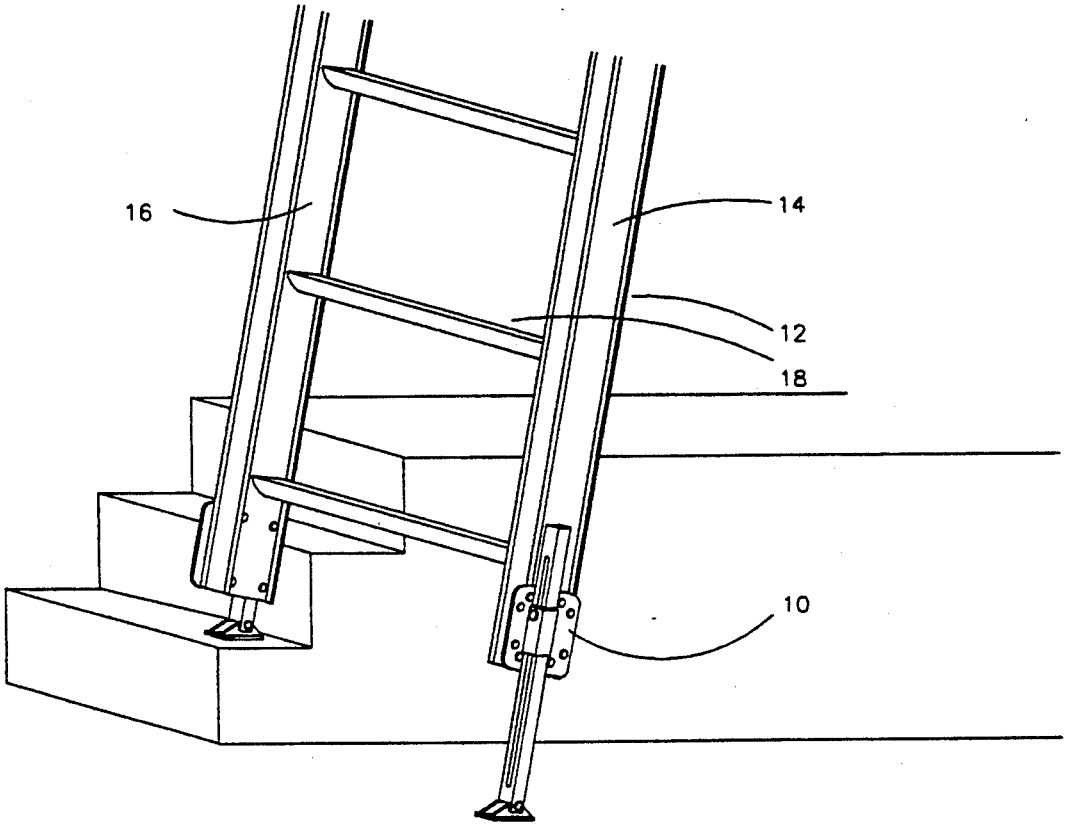
FIG. 1 is a view in perspective of one form of ladder leveling device of the invention in use with a ladder.

Turning now descriptively to the drawings, in which similar reference characters denote similar elements throughout the several views, FIG. 1 shows generally a ladder leveling device 10 in use with a conventional ladder 12 having a pair of siderails 14, 16 which are connected together by means of rungs 18. In order to provide a means whereby the siderails 14, 16 may be disposed in substantially a vertical position irrespective of the contour or inclination of the ground or surface on which the ladder rests, the ladder leveling device 10 is provided as hereinafter described.

Figure 2:
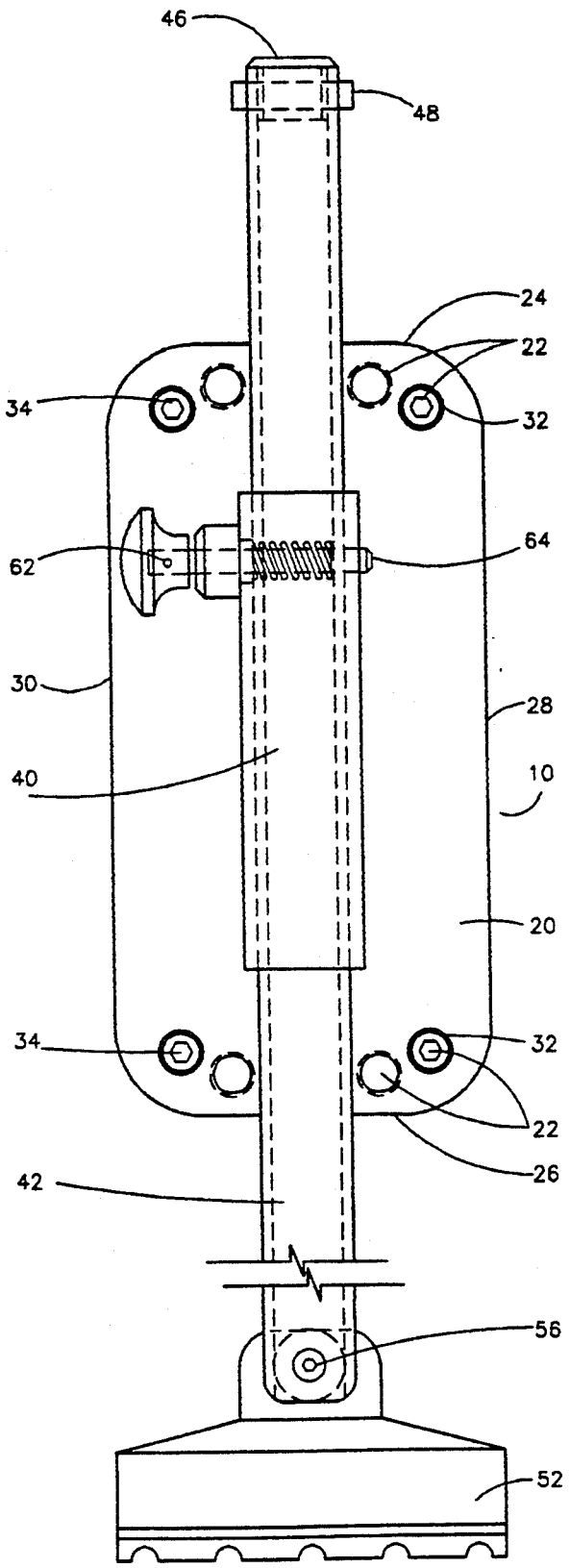
FIG. 2 is a side view of one form of ladder leveling device of the invention.
Figure 3:
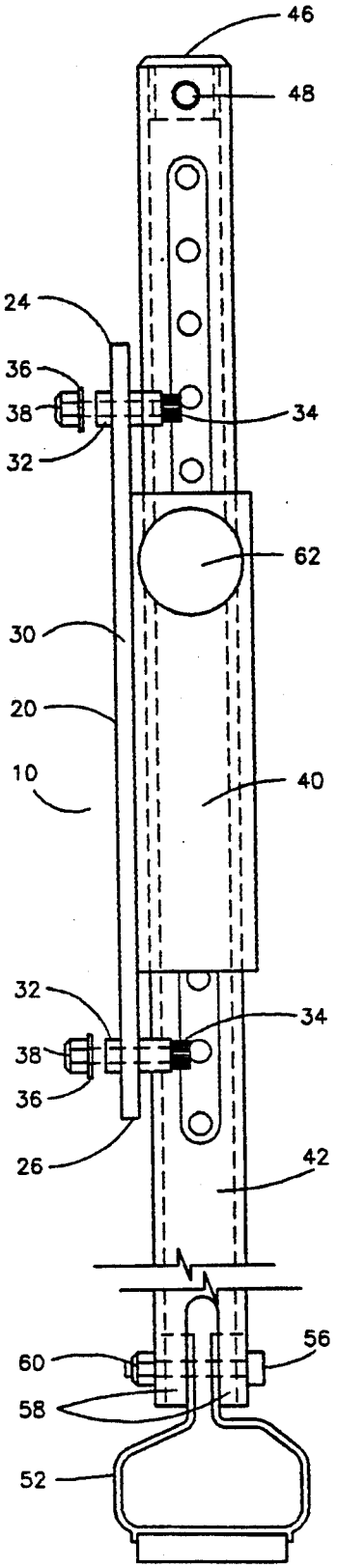
FIG. 3 is a frontal view of one form of the ladder leveling device of the invention.
Figure 4:
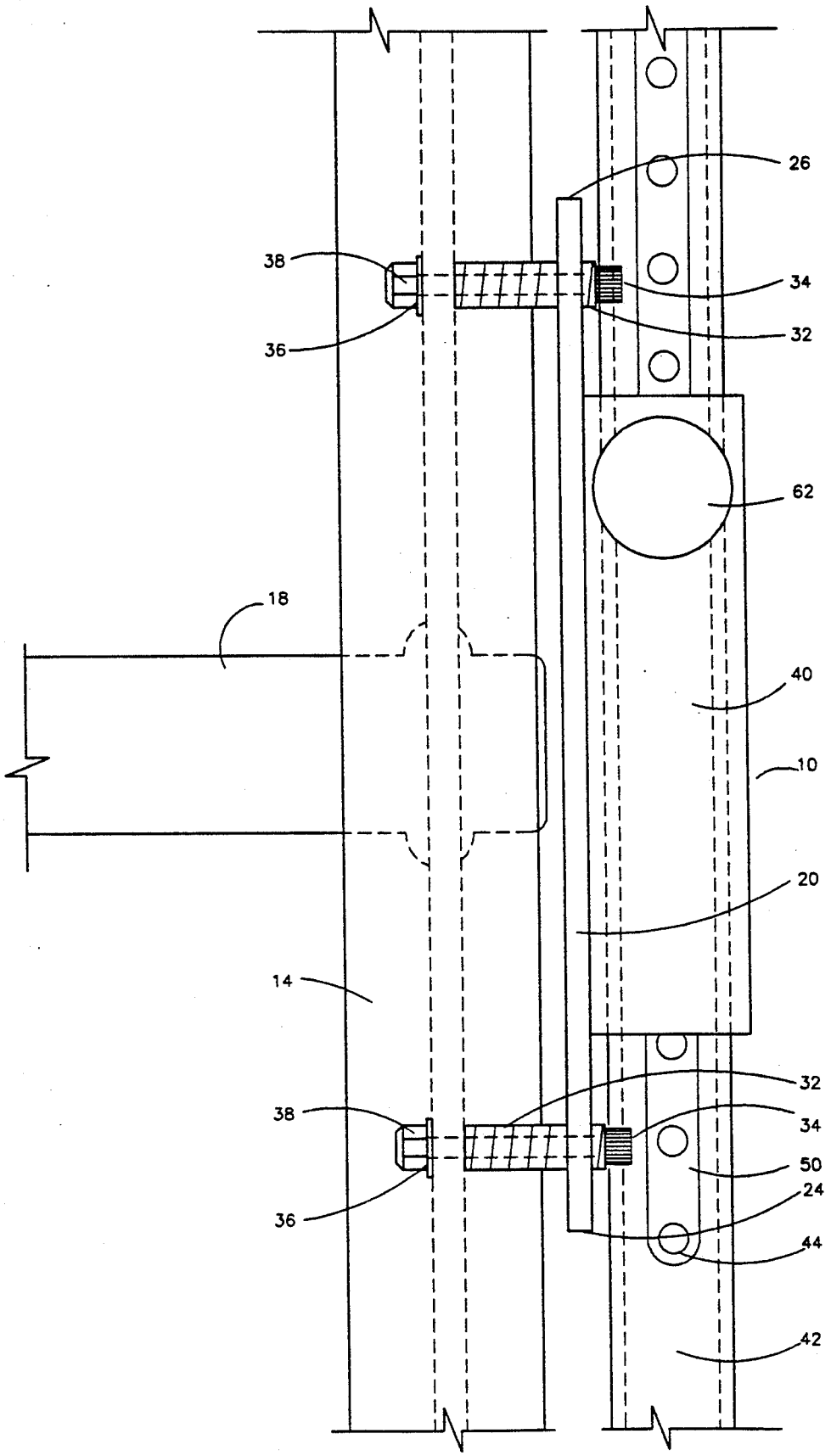
FIG. 4 is a frontal view close-up of one form of the ladder leveling device of the invention showing attachment to a ladder.

FIGS. 2, 3 and 4 show a ladder leveler 10 comprising a generally rectangular shaped base plate 20 having two wide ends 24, 26 and two long sides 28, 30. In one embodiment, the rectangular shaped base plate 20 is four inches wide by eight inches long. The rectangular shaped base plate 20 has a plurality of threaded holes 22. The plurality of threaded holes 22 are located on each wide end 24, 26 of the rectangular shaped base plate 20. In one embodiment, the plurality of threaded holes 22 comprise eight one-quarter inch threaded holes, with four holes located proximate to each wide end 24, 26, and the first of the four holes located $\frac{5}{8}$ inches on center from both the wide end 24 edge and long side edge 28 of the rectangular shaped base plate 20, the second of the four holes located $\frac{5}{8}$ inches on center from the first hole, the third of the four holes located $1\frac{1}{2}$ inches on center from the second hole, and the fourth of the four holes located $\frac{5}{8}$ inches on center from the third hole, the wide end 24 edge and the long side edge 30 opposite the first hole, and the four remaining holes are situated in the same manner on the wide end 26 of the rectangular shaped base plate 20 opposite the location of the first four holes. The plurality of threaded holes 22 in the rectangular shaped base plate 20 allow for universal mounting on various width or configured ladder side-rails 14, 16. A plurality of hollow jack screws 32 are provided which are complimentary to and thread through the plurality of threaded holes 22 in the rectangular shaped base plate 20. A plurality of Allen head bolts 34, washers 36 and lock-nuts 38 are provided, which bolts 34 repose freely within the hollow jack screws 32. The configuration of the plurality of threaded holes 22, the plurality of hollow jack screws 32, and the plurality of Allen head bolts 34, washers 36 and locknuts 38 provide for universal application of the ladder leveler 10 on ladders of any design leg or rail and construction of any component, i.e., wood, aluminum, fiberglass. The configuration provides for attachment to legs/rails of any thickness component of webbing and yet allows for clearance of the rung welds in the webbing which normally protrude beyond the face of webbing and rail. The attachment of the ladder leveler 10 also provides safety by restricting structural weakening, buckling, or twisting of the ladder leg or rail by means of securing firmly the hollow jack screws 32 and the Allen head bolts 34, washers 36 and locknuts 38.

A square tubular guide 40 is provided which attaches longitudinally to the center of rectangular shaped base plate 20. A square tubular shaft 42 is provided which is slidable within the square tubular guide 40. A plurality of longitudinally aligned holes 44 are provided in the center of one longitudinal side of the square tubular shaft 42 extending at $\frac{3}{4}$ inches each on center for a length of $9\frac{3}{4}$ inches beginning $\frac{3}{4}$ inches from one end 46 of the square tubular shaft 42. In one embodiment, the plurality of longitudinally aligned holes 44 measure 9/32 inches in circumference. A restraint 48 through the square tubular shaft 42 is located at the end 46 of the square tubular shaft 42 where the plurality of longitudinally aligned holes 44 commence. A $\frac{1}{2}$ inches wide longitudinal cut-out 50 is provided in the center of the longitudinal side of the square tubular shaft 42 opposite the longitudinal side containing the plurality of longitudinally aligned holes 44, which longitudinal cut-out 50 extends from the end 46 of the square tubular shaft 42 where the plurality of longitudinally aligned holes 44 commence a distance commensurate with the longitudinal distance on the square tubular shaft 42 of the plurality of longitudinally aligned holes 44.

A pivoting foot 52 is provided which secures to the end 54 of the square tubular shaft 42 opposite the end 46 of the square tubular shaft 42 where the restraint 48 is located by means of a bolt 56, a plurality of spacers 58 and a locknut 60. A spring biased pin means 62 attaches to the center of the square tubular guide 40, which spring biased pin means 62 has a circular shaft 64 extending through the square tubular guide 40, the longitudinal cutout 50, the plurality of longitudinally aligned holes 44, and a complimentary hole 66 on the side of the square tubular guide 40 opposite where the spring biased pin means 62 is mounted.

It will be apparent that various modifications can be made in the particular ladder leveler device described above and shown in the drawings within the scope of the present invention. The size, configuration and arrangement of components can be different to meet specific requirements. These and other changes can be made in the ladder leveler device provided the functioning and operation thereof are not adversely affected. Therefore, the scope of the present invention is to be limited only by the following claims.

What is claimed is:

1. Ladder leveler device comprising:

generally rectangular shaped base plate;

the base plate having a plurality of threaded holes;

a plurality of hollow jack screws which are complimentary to and thread through the plurality of threaded holes in the base plate;

a plurality of Allen head bolts, washers and lock-nuts which bolts repose freely within the hollow jack screws;

a longitudinally disposed square tubular guide attached to the center of base plate;

a square tubular shaft which is slidable within the square tubular guide;

a plurality of longitudinally aligned holes on one longitudinal side of the square tubular shaft;

a restraint through the square tubular shaft located at an end of the square tubular shaft where the plurality of longitudinally aligned holes commence;

a longitudinal cut-out of the center of the longitudinal side of the square tubular shaft opposite the longitudinal side of the square tubular shaft containing the plurality of longitudinally aligned holes;

a pivoting foot secured to an end of the square tubular shaft opposite the end of the square tubular shaft where the plurality of longitudinally aligned holes commence;

a spring biased pin means attached to the center of the square tubular guide.

2. Ladder leveler device according to claim 1 wherein said generally rectangular shaped base plate includes a width of four inches and a length of eight inches.

3. Ladder leveler device according to claim 1 wherein said plurality of threaded holes includes eight one-quarter inch threaded holes, said holes being located four each on each wide end of the base plate with the first of the four holes located $\frac{5}{8}$ inches on center from both the wide edge and the long edge of the rectangular shaped base plate, the second of the four holes located $\frac{5}{8}$ inches on center from the first hole, the third of the four holes located $1\frac{5}{8}$ inches on center from the second hole, and the fourth of the four holes located $\frac{5}{8}$ inches on center from the third hole and the long edge opposite the first hole, the four remaining holes are situated in the same manner on the wide end of the rectangular shaped base plate opposite the location of the first four holes.

4. Ladder leveler device according to claim 1 wherein said plurality of longitudinally aligned holes on one longitudinal side of the square shaft include extending at ¾ inches each on center for a length of 9¾ inches beginning ¾ inches from one end of the square shaft.

5. Ladder leveler device according to claim 1 wherein said plurality of longitudinally aligned holes on one longitudinal side of the square shaft include a plurality of longitudinally aligned 9/32 inch holes.

6. Ladder leveler device according to claim 1 wherein said longitudinal cut-out of the center of the side of the square tubular shaft includes a ½ inch longitudinal cut-out of the center of the side of the square tubular shaft opposite the side containing the plurality of longitudinally aligned holes, which longitudinal cut-out extends from the end of the square tubular shaft from the end of the square shaft where the plurality of longitudinally aligned holes commence a distance commensurate with the longitudinal distance on the square tubular shaft of the plurality of longitudinally aligned holes.

7. Ladder leveler device according to claim 1 wherein said pivoting foot secured to the end of the square tubular shaft opposite the end of the square tubular shaft where the plurality of longitudinally aligned holes commence includes means of a bolt, a plurality of spacers and a locknut.

8. Ladder leveler device according to claim 1 wherein said spring biased pin means attached to the center of the square tubular guide include a shaft extending through the square tubular guide, the plurality of longitudinally aligned holes and the longitudinal cut-out, and through a complimentary hole on the side of the square tubular guide opposite where the spring biased pin means is mounted.

* * * * *